US006866124B1

(12) United States Patent
Barkis

(10) Patent No.: US 6,866,124 B1
(45) Date of Patent: Mar. 15, 2005

(54) VEHICLE LIFT HAVING DIAGONALLY OFFSET SUPPORT COLUMNS

(76) Inventor: P. Michael Barkis, 15834 Brothers Ct., Fort Myers, FL (US) 33912

( * ) Notice: Subject to any disclaimer, the term of this patent is extended or adjusted under 35 U.S.C. 154(b) by 138 days.

(21) Appl. No.: 10/171,033

(22) Filed: Jun. 11, 2002

(51) Int. Cl.[7] ..... B66F 7/12
(52) U.S. Cl. ..... 187/213; 187/219; 414/233
(58) Field of Search ..... 187/203, 209, 187/210, 213, 219; 414/233, 249, 427; 254/89 R

(56) References Cited

U.S. PATENT DOCUMENTS 620,585 A * 3/1899 Hayes ..... 187/270
2,513,433 A * 7/1950 Skow ..... 414/926
2,702,606 A * 2/1955 Young ..... 414/233
4,084,790 A * 4/1978 Molnar ..... 187/219
4,212,449 A * 7/1980 Tsujimura ..... 187/213
4,763,761 A * 8/1988 McKinsey et al. ..... 187/213
4,934,487 A * 6/1990 Isogai ..... 187/213
4,962,832 A * 10/1990 Maney ..... 187/209
5,009,287 A * 4/1991 Starr ..... 187/213
5,954,160 A * 9/1999 Wells, Sr. et al. ..... 187/203

* cited by examiner

*Primary Examiner*—Eileen D. Lillis
*Assistant Examiner*—Thuy V. Tran
(74) *Attorney, Agent, or Firm*—William E. Noonan

(57) ABSTRACT

A motor vehicle or marine lift utilizes diagonally offset support columns. The columns face one another and are arranged along a line that intersects the longitudinal axis of the motor vehicle or vessel at a non-perpendicular angle. A respective pair of pivoting asymmetric support arms are connected to each column for moving upwardly and downwardly along the column to raise and lower a motor vehicle or marine vessel mounted thereon.

19 Claims, 5 Drawing Sheets

VEHICLE LIFT HAVING DIAGONALLY OFFSET SUPPORT COLUMNS

FIELD OF THE INVENTION

This invention relates to a lift for motor vehicles and marine vessels, and more particularly, to a lift having vertical support columns that are offset diagonally along the longitudinal axis of the lift bay.

BACKGROUND OF THE INVENTION

Various automotive lifts are currently known. Above-ground lifts typically employ a pair of opposing posts or columns positioned along respective sides of the vehicle and facing one another at right angles to the longitudinal axis of the lift bay. In a symmetric lift, a pair of symmetrically folding support arms are mounted to each column. The arms are mounted to be raised and lowered on their respective columns. The support arms also pivot together and apart in a scissor-like manner. A vehicle is driven between the columns and the arms are properly positioned beneath the undercarriage of the vehicle. Ideally, the lift arms are placed so that they respectively engage the undercarriage of the vehicle at equal distances forwardly and rearwardly of the center mass of the vehicle. The lift is then operated so that the arms raise and lower the vehicle between the columns.

Symmetric lifts provide generally satisfactory balance for most passenger cars. In addition, this type of lift allows the vehicle to enter the lift bay from either direction. However, symmetric lifts also exhibit a number of problems. After an automobile is properly positioned on the lift, it can be difficult, if not impossible, to fully open the vehicle's doors because they are obstructed by the lift columns. This frustrates the lift operator attempting to enter or leave the vehicle. The car doors are also apt to bump into the columns, which can damage the doors. Furthermore, it can be annoying, inconvenient and time consuming to properly adjust the position of an automobile having a short wheel base on the symmetric lift. This often requires that the car be moved repeatedly back and forth small distances so that the lift arms dear the vehicle's wheels but at the same time proper balance is obtained.

Asymmetric lifts have been developed as an alternative to the symmetric mechanisms described above. In this type of lift, each vertical column movably supports a pair of pivot arms that fold or collapse in the same direction. This contrasts with the symmetric lift wherein the pivot arms collapsibly fold in opposing directions. In most asymmetric lifts, the vertical support columns are positioned beside respective sides of the vehicle forwardly of the longitudinal midpoint or center of the mass of the vehicle.

The off-center positioning of the columns in an asymmetric lift allows much improved access to, and far easier opening and closing of the car's doors. The posts or columns are usually located sufficiently forwardly along the car so that the doors easily clear the columns when they are opened and closed. This allows the lift operator to conveniently enter and leave the vehicle after it is positioned on the lift. It is also quicker and easier to position automobiles having short wheel bases on an asymmetric lift.

Unfortunately, asymmetric lifts also exhibit a number of disadvantages. Because the lift arms do not extend to engage the undercarriage of the vehicle in a symmetric manner, it can be difficult and time consuming to property position and balance the vehicle on the lift. Proper balancing is critically important because a vehicle incorrectly balanced on the lift can present a serious risk of personal injury and property damage. Moreover, the driver's door on many vans is situated such that it strikes the support column of the asymmetric lift when the door is opened. Therefore, the asymmetric lift exhibits the same disadvantage for vans as the symmetric lift exhibits when used for a passenger car. Asymmetric lifts also lack the flexibility of symmetric mechanisms and are generally approachable by the vehicle in only one direction.

Many conventional asymmetric lifts are positioned such that they directly face one another on opposite sides of the vehicle bay. The arms supporting the vehicle thereby exert an uneven load on the carriage bearings of the lift. This tends to cause premature bearing wear, which can necessitate expensive repairs to the lift. At least one known lift has turned or rotated the columns so that they do not directly face one another. This has helped to alleviate uneven bearing wear somewhat. However, as with other asymmetric lifts, the columns in this mechanism are arranged along a transverse line that is substantially perpendicular to the longitudinal axis of the vehicle bay. As a result, most of the other problems associated with asymmetric lifts remain. In particular, it is difficult to open and close the doors of a van or similar vehicle because of interference from the columns. Safe and proper balancing also remains problematic.

Virtually all conventional above-ground lifts currently in use experience serious spacing problems. The work bays in most automotive garages have widths of approximately 10'–12'. The width of most conventional motor vehicle lifts is about 11'6". As a result, fitting adjacent lifts within the space available in the garage can be complicated, if not impossible. Even in facilities where each bay has a width of 12', this leaves a space of only about 6" between the side-by-side columns of adjacent lifts. There is little, if any, room for the lift operators and other garage personnel to pass between the columns of the adjacent bays. With even narrower bays (e.g. those on the order of 10' in width), this difficulty is exacerbated. It is virtually impossible to install most above-ground vehicle lifts in adjacent bays having such narrow widths. As a result, a garage having only a limited amount of space is severely restricted in the number of lifts that it can utilize. Some lifts have installed columns having an outside width of only about 10' 8", which increases the clearance between adjacent lifts. However, in such cases it becomes extremely difficult to open and close the doors of the vehicle due to the narrow spacing between columns. Lifts having such a narrow column spacing also restrict wide vehicles from being positioned on the lift.

SUMMARY OF THE INVENTION

It is therefore an object of the present invention to provide a vehicle lift having uniquely positioned, diagonally offset support columns which overcome a number of problems exhibited by conventional symmetric and asymmetric vehicle lifts.

It is a further object of this invention to provide a vehicle lift that enables the driver's door in virtually all types of cars and vans to be opened and closed without obstruction from the lift column.

It is a further object of this invention to provide a vehicle lift which supports virtually all types of motor vehicles in a safe, balanced manner and which, as a result, significantly reduces the risk of personal injury and property damage.

It is a further object of this invention to provide a vehicle lift that can be approached and entered from either of two opposing directions and which provides for improved versatility and a more flexible and efficient garage and work bay design.

It is a further object of this invention to provide a vehicle lift that is quickly and conveniently positionable under small cars having short wheel bases and which does not require repeated, annoying and time consuming adjustment of the car's position on the lift.

It is a further object of this invention to provide a vehicle lift that employs asymmetrically operable support arms but at the same time more evenly distributes and balances the vehicle load on the carriage bearings on the lift so that premature bearing wear and expensive repairs are avoided.

It is a further object of this invention to provide a vehicle lift that significantly reduces the balance problems exhibited in most conventional asymmetric lifts.

It is a further object of this invention to provide a vehicle lift that significantly improves and increases the clearance between adjacent lifts so that garage personnel are able to pass more conveniently and safely between the lifts.

It is a further object of this invention to provide a vehicle lift that allows multiple lifts to be arranged conveniently side-by-side in narrow garage bays without the column clearance problems found in conventional lifts.

It is a further object of this invention to provide a vehicle lift that permits the garage to use relatively narrow lift bays and which thereby allows a larger number of bays to be employed in a predetermined garage space so that workspace efficiency is improved considerably.

It is a further object of this invention to provide a vehicle lift that permits multiple side-by-side lifts to be employed in extremely narrow work bays without restricting opening and closing of the doors of a vehicle mounted on the lift.

It is a further object of this invention to provide a vehicle lift having a satisfactorily wide column spacing that allows the vehicle to be readily positioned on and removed from the lift and which has an improved capacity to accommodate wide vehicles.

It is a further object of this invention to provide a vehicle lift having support arms that offer a wide range of undercarriage contact area and which are adaptable for use with virtually all types of motor vehicles.

It is a further object of this invention to provide a lift that may be used advantageously for marine vessels as well as motor vehicles.

This invention results from a realization that the foregoing advantages may be achieved by diagonally offsetting the vertical support columns of a motor vehicle lift and arranging these columns along a line that intersects the longitudinal axis of the vehicle bay at a non-perpendicular angle, and further by orienting the columns such that they face one another. As used herein, "diagonally offset" means that the columns are longitudinally offset from one another relative to the longitudinal axis of the lift bay.

This invention features an automotive and/or marine lift having a pair of vertical support columns for positioning along respective sides of the vehicle or vessel to be lifted. The columns are arranged along a line that intersects the longitudinal axis of the vehicle or vessel bay at a non-perpendicular angle. A first pair of pivoting support arms are mounted to a first one of the support columns for moving selectively in upward and downward directions along the first column. A second pair of pivoting support arms are similarly mounted to a second one of the columns for moving selectively in upward and downward vertical directions along the second column. A vehicle or vessel is positioned in the bay between the support columns such that the longitudinal axis of the vehicle or vessel is aligned with or generally parallel to the longitudinal axis of the bay in which the lift is installed. As a result, the longitudinal axis of the vehicle or vessel intersects the line interconnecting the support columns at the non-perpendicular angle. With the support arms positioned proximate the lower ends of their respective support columns, the first pair of support arms are pivotably adjusted beneath and engaged with the undercarriage of the vehicle or the hull of the vessel proximate one side thereof. The second pair of support arms are similarly pivotably adjusted beneath and engaged with the undercarriage of the vehicle or the hull of the vessel proximate the opposite second side thereof. The support arms are selectively positioned, for example, to clear the wheels of the vehicle and to balance the vehicle on the support arms as the lift is operated. A drive mechanism is actuated to raise the first and second pairs of support arms and thereby elevate the vehicle or vessel. When desired, operation of the drive mechanism may be reversed to lower the first and second pairs of support arms along the first and second columns respectively and thereby lower the vehicle or vessel.

In a preferred embodiment, the first and second columns face one another. The columns may be arranged along a diagonal line that intersects the longitudinal axis of the vehicle or vessel bay at an angle of approximately 56°.

Each pair of support arms may be pivotably mounted to a carriage that is movably mounted within a longitudinal channel of a respective support column. The drive mechanism may comprise any one of a number of motors and related drive assemblies (e.g. hydraulic, pneumatic, mechanical) of the type conventionally used in the automotive or marine lift industries. The longitudinal channel may be formed in a generally inwardly facing side of the respective column. The inwardly facing sides and respective channels of the columns preferably face one another along the non-perpendicular line interconnecting the columns.

A pair of asymmetrically folding arms may be pivotably and vertically movably interconnected to a respective one of the support columns. Each arm in the pair pivots in generally the same direction between a folded or collapsed condition, wherein the arms are juxtaposed, and an extended condition wherein the arms are pivotably deployed for engaging the undercarriage of the vehicle or the hull of the vessel. Each arm may be telescopically or otherwise longitudinally adjustable for positioning the arm at a selected location of the undercarriage of the vehicle or the hull of the vessel.

DETAILED DESCRIPTION OF PREFERRED EMBODIMENTS

Other objects, features and advantages will occur from the following description of a preferred embodiment and the accompanying drawings, in which.

Figure 9:
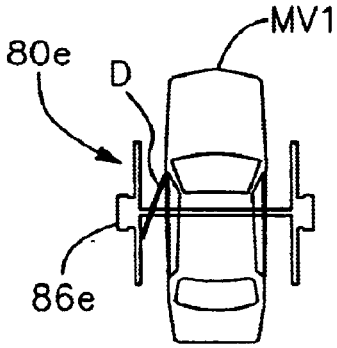
Fig. 9 Prior Art
Figure 10:
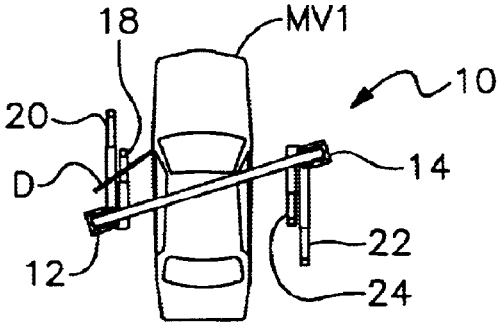

FIG. 9 is a top schematic view of a conventional symmetric lift with a motor vehicle positioned therein and particularly depicting the interference that the vertical support column causes with opening and closing the driver's door of the vehicle; and FIG. 10 is a schematic view similar to FIG. 9 depicting the diagonally offset lift of the present invention and particularly illustrating that a door of a motor vehicle located in the lift may be opened and closed without obstruction from the vertical support column of the lift.

Figure 1:
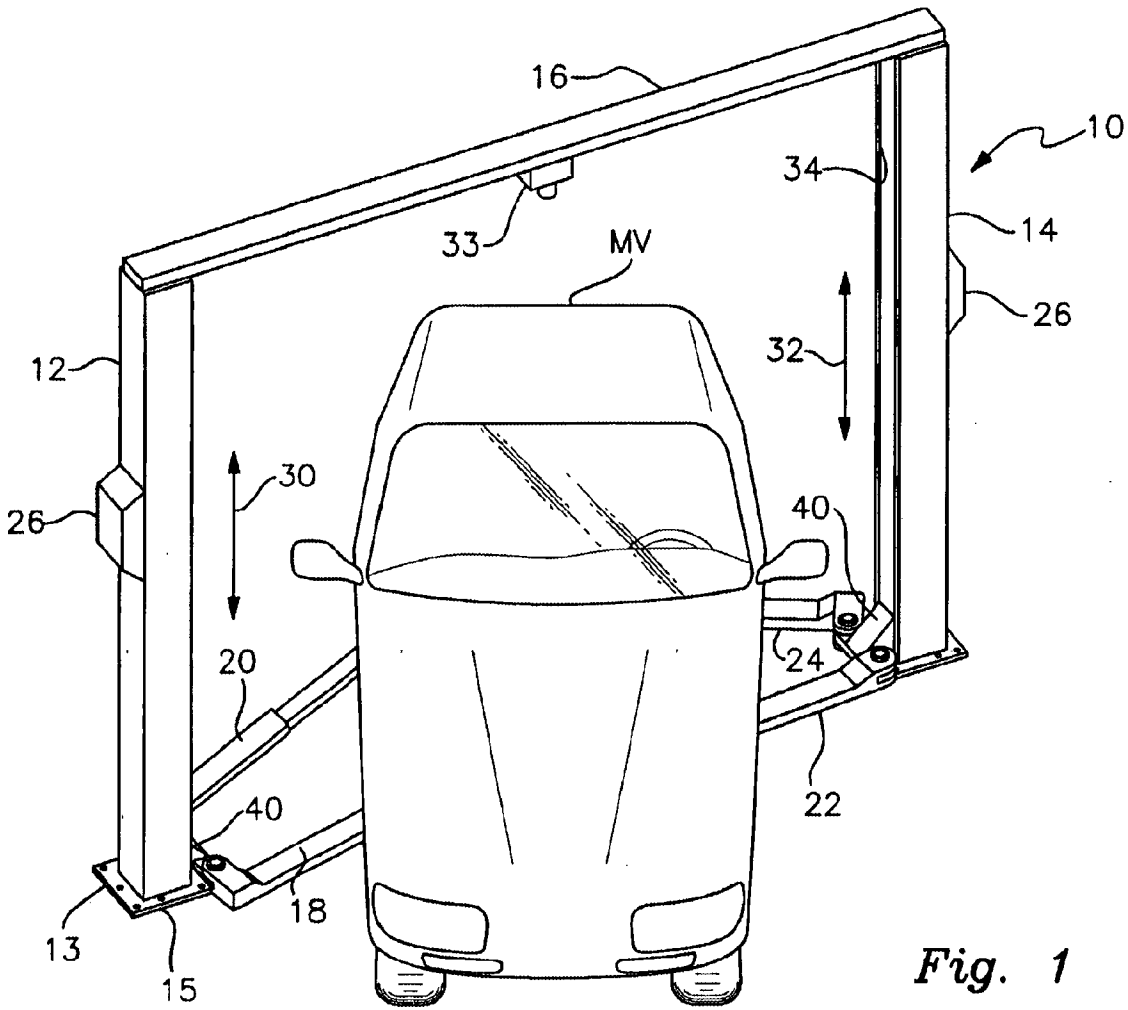
FIG. 1 is a perspective view of a preferred vehicle lift having diagonally offset support columns according to this invention, with a motor vehicle positioned over the lowered support arms of the lift.
Figure 2:
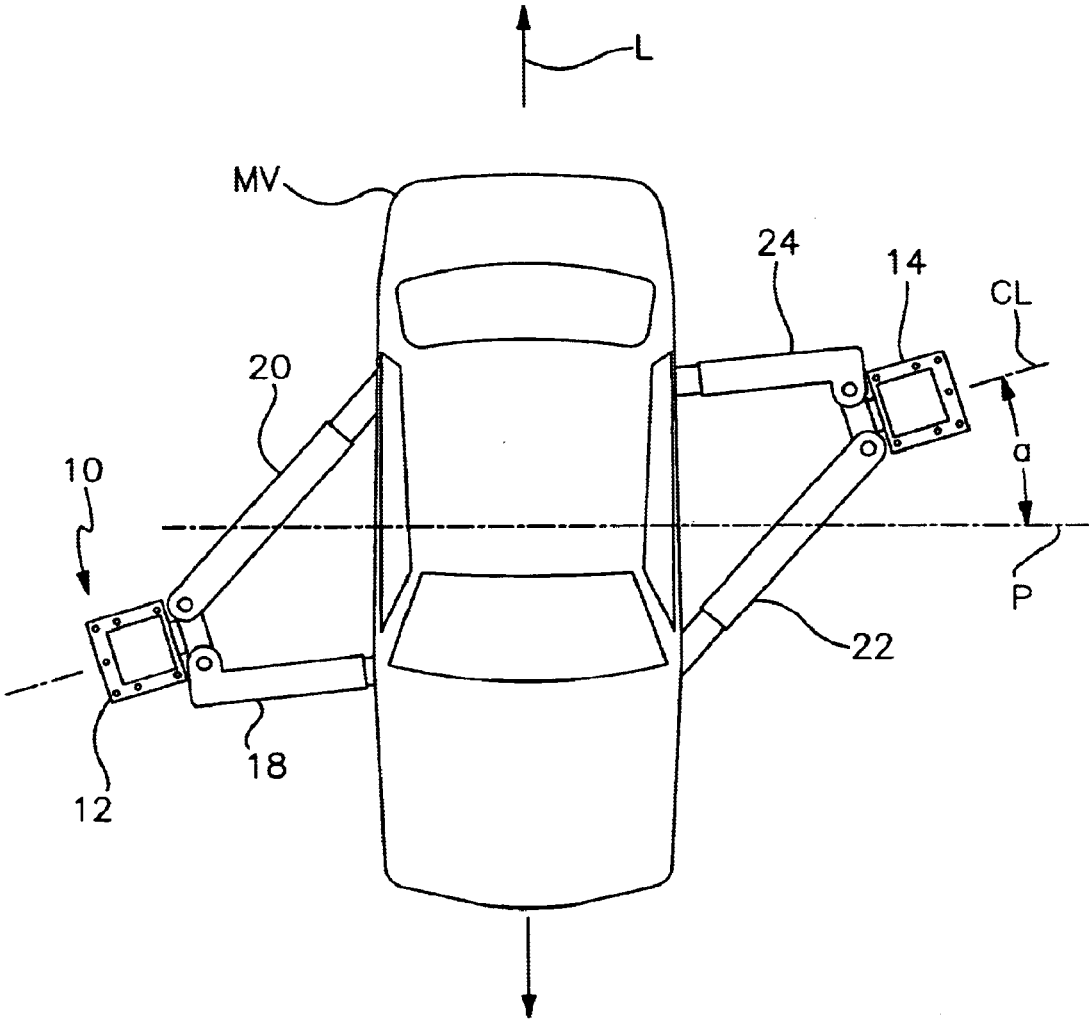
FIG. 2 is a top plan view of the lift and motor vehicle shown in FIG. 1.

There is shown in FIGS. 1 and 2 a vehicle lift apparatus 10 having diagonally offset, vertical support columns 12 and 14. The lift is particularly described herein as used for a motor vehicle. It should be understood, however, that "vehicle" is intended to comprise both land and marine vehicles. In the version illustrated in the drawings, lift 10 is located within a garage of other motor vehicle repair/service facility. The lift is used in association with a respective bay that accommodates a motor vehicle MV to be lifted. Support columns 12 and 14 are secured to the floor by respective mounting plates 13 and bolts 15. The columns are interconnected in a conventional manner such as by an overhead beam 16, which may be composed of a square steel tubing or an analogous component. The overhead beam is omitted in FIG. 2 for clarity.

A first pair of asymmetrically pivoting support arms 18 and 20 are operably mounted to column 12 and a second pair of asymmetrically pivoting support arms 22 and 24 are similarly mounted to column 14. The specific manner of mounting the support arm pairs to their respective columns is described more fully below. It should be understood that many conventional above-ground lifts employ vertical support columns and pivoting pairs of support arms that are movably mounted to the vertical columns. As in the prior art, the present apparatus operably interconnects the support arms to the columns and employs a drive mechanism for raising and lowering the support arm pairs relative to their respective columns. For example, the lift may feature a hydraulic drive mechanism including a suitable hydraulic pump and cylinders. Mechanical and screw drivers may also be used. The drive mechanism is operated by a power unit 26 comprising a motor, which may be mounted to one or both of the columns. The particular details of the power unit and other components of the drive mechanism will be well understood to persons skilled in the lift art and are not specifically described or comprise a part of this invention. The power units are operably interconnected to the support arms 18, 20 and 22, 24 again in a known and conventional manner. The drive mechanism is selectively actuated by the lift operator or other garage personnel to raise and lower support arms 18, 20 and 22, 24 along respective support columns 12 and 14 in a conventional manner, as indicated by doubleheaded arrows 30 and 32, FIG. 1. This raises and lowers motor vehicle MV, which is positioned on the lift in a manner that is described more fully below. A limit switch 33 attached to beam 16 is engaged by the vehicle to limit upward movement of the drive mechanism.

Figure 3:
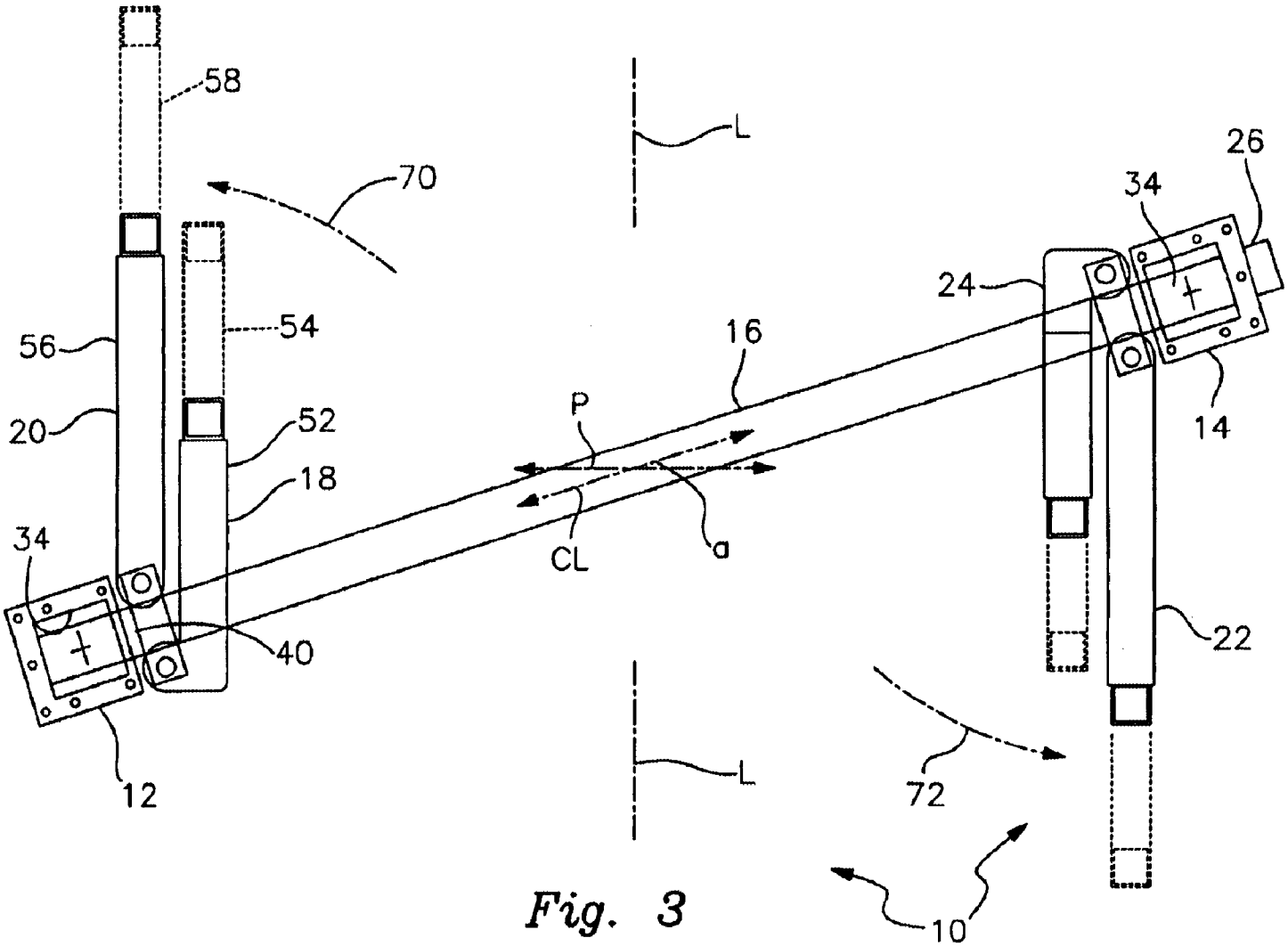
FIG. 3 is a top plan view of the lift with the support arms in a folded condition.

Lift 10 is shown alone in FIG. 3, with the support arms in a collapsed, folded condition. Each column 12, 14 comprises a vertically elongate generally square tube composed of steel or some other heavy-duty metal or metal alloy. The support columns may have various lengths, widths and wall thickness dimensions within the scope of this invention. Each column further includes an interior longitudinal recess or channel 34 (see also FIGS. 4 and 5) that accommodates the hydraulic cylinder and/or other working components of the drive mechanism. As best shown in FIGS. 2–3, columns 12 and 14 face each other along a diagonal centerline CL. More particularly, the opposing inwardly facing sides of columns 12 and 14 are open to expose longitudinal channels 34, which similarly face one another along centerline CL. The centerline intersects a longitudinal axis L, which comprises the longitudinal axis of the motor vehicle bay utilizing lift 10. When the motor vehicle is positioned within the bay as shown in FIGS. 1 and 2, its longitudinal axis is coincident or generally parallel to axis L. In most conventional lifts, the vertical support columns are positioned along a transverse line P, FIGS. 2 and 3, which is perpendicular (at 90°) relative to longitudinal axis L. In the present invention, however, the line CL along which columns 12 and 14 are arranged and face one another is not coincident with line P but rather intersects that line at an angle which is approximately 34°. By the same token, column centerline CL intersects axis L at an angle of 56°, rather than 90° as in the prior art. This orientation provides substantial benefits which are described more fully below.

Figure 4:
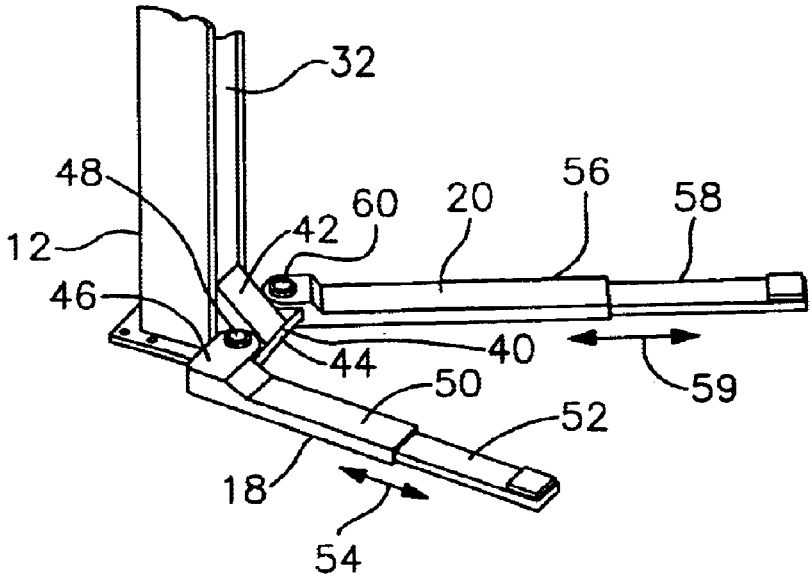
FIG. 4 is a perspective view of one pair of the support arms located at a lower end of a respective support column.
Figure 5:
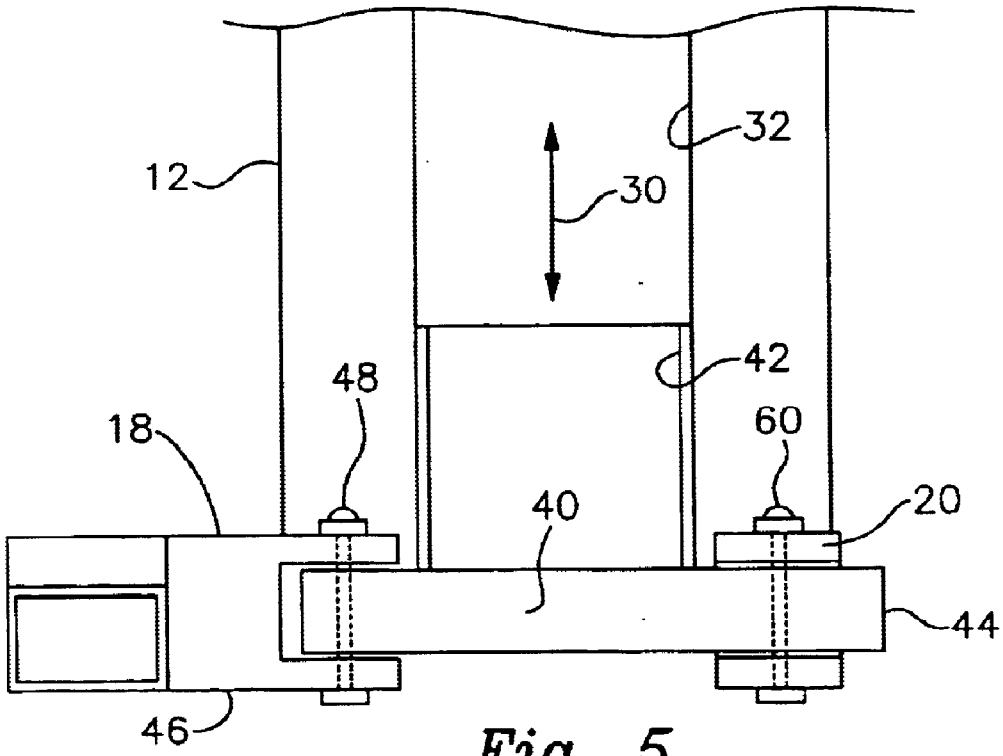
FIG. 5 is an elevational, cross sectional view of the lower end of one of the support columns and the support arm assembly operably mounted thereto.

As best shown in FIGS. 3–5, support arms 18 and 20 are pivotably mounted to carriage 40, which is itself mounted in channel 32 of column for moving up and down along the column as indicated by doubleheaded arrow 30. Similarly, second pair of arms 22 and 24 are pivotably mounted to a second carriage 40 movably associated with column 14. The particular details of the carriages and the manner of mounting the pivoting arms to the carriages are best represented in FIGS. 4 and 5 in connection with column 12 and support arms 18 and 20. In particular, carriage 40 includes a slide portion 42 that is mounted within channel 32 and retained therein for sliding upwardly and downwardly as indicated by doubleheaded arrow 30. Component 42 is cooperatively and operably interconnected with the hydraulic drive mechanism or other operating components of the drive mechanism. Once again, this manner of interconnection and operation will be understood to persons skilled in the art and does not comprise a part of this invention. A drive plate 44 is attached permanently to component 42 exteriorly of the column. Support arm 18 includes an inwardly turned inner end portion 46 that is interconnected to plate 40 by a pivot pin 48. A pair of telescopically interconnected arm portions 50 and 52 are attached to end portion 46 and extend outwardly therefrom at a perpendicular angle. Arm portions 50 and 52 may comprise sections of steel square tubing or similar components that are slidably adjustable, as indicated by doubleheaded arrow 54, so that the length of arm 14 may be adjusted as required.

Arm 20 likewise includes a pair of telescopically adjustable arm components 56 and 58 that are interconnected at an inner end of the arm to plate 44 by a pivot pin 60. Components 56 and 58 may be solid or comprise rectangular tubing composed of steel or a similar material. The arm components are slidably adjustable as indicated by doubleheaded arrow 59 in order to adjust the length of arm 20 as required.

It should be understood that the support arms 22 and 24 associated with vertical support column 14 are constructed and operate in a manner analogous to that described for arms 18 and 20 respectively.

The support arms are depicted in an open, deployed condition in FIGS. 1, 2, 4 and 5. Alternatively, when the lift is not in use, the support arms are folded into a collapsed or stored condition. This is best shown in FIG. 3. Specifically, with carriage 40 in its lowermost position along columns 12, arms 18 and 20 are pivoted as indicated by arrow 70 so that the arms are collapsed and folded together in a juxtaposed condition. Each arm extends in a direction generally parallel to the longitudinal axis L. Similarly, arms 22 and 24 are folded in the direction of arrow 72 such that they are juxtaposed against one another and also aligned generally parallel to longitudinal axis L. In FIG. 3, the support arms are depicted in phantom to illustrate the full length of the arms in their extended condition. When the arms are folded closed, they typically are in a telescopically collapsed state. It should be understood that the lengths of the arms and arm portions may vary within the scope of this invention. Preferably, support arm 18 may extend from a minimum length of 26" in a collapsed condition to a maximum length of 45" in an extended condition. These dimensions also apply to support arm 24. By the same token, support arms 20 and 22 may extend from a minimum length of approximately 40" to a maximum length of approximately 62". These dimensions are illustrative only and should not be deemed to be a limitation of this invention. It should also be understood that the width or thickness of the arms may vary. A preferred width of the inner arm components is 5"–6" and a preferred width of the distal arm components is about 4'.

The columns 12 and 14 and their associated support arms are positioned by the user to provide a safe balanced support for the vehicle and, at the same time, to maximize the efficiency of spacing between adjacent lifts and minimize obstruction of the lift columns with the vehicle doors. These dimensions may be varied within the scope of this invention. In the version shown in FIG. 3, the overall width across the bay (e.g. the maximum width of overall lift 10) is 12'4" with the columns and arms diagonally offset along longitudinal axis L and angled relative to perpendicular line P in the manner shown, a vehicle drive-through width of 8'4" is provided. With perpendicular line P also representing the approximate longitudinal midpoint at which the vehicle is positioned, there is a distance of approximately 21" from line P to the center of each column. In other words, the center of column 12 is located 21" in front of line P and the center of column 14 is located 21" behind line P (assuming that the vehicle enters the bay in the direction extending top to bottom in FIG. 3). Once again, these particular dimensions, as well as the precise angle at which the columns are arranged relative to axis L and line P may be varied within the scope of this invention. In all cases, however, the columns should be positioned along a line that is not perpendicular to the longitudinal axis such that when the asymmetric support arms are unfolded and deployed, they can be positioned to engage the undercarriage of the vehicle and support the vehicle in a balanced manner analogous to that provided by a symmetric lift. Additionally, the positioning should be made so that the doors of the vehicle are able to open and close without obstruction from the columns.

In operation, a vehicle drives into the lift bay (for example in the direction from top to bottom in FIG. 3) such that it maintains a longitudinal axis L in the bay. The vehicle is positioned in the bay so that the longitudinal midpoint of the vehicle is approximately midway between the columns. The bay may be marked to indicate this midpoint and assist the operator. Support arms 18, 20 and 22, 24 are then unfolded and telescopically extended to the degree necessary to properly position the support arms under the vehicle. The distal end of each support arm carries a support pad in a conventional manner. The experienced operator is able to quickly and conveniently position the support arms beneath the undercarriage of the vehicle so that a symmetrical balanced support will be achieved when the vehicle is lifted. After positioning of the arms is accomplished, the vehicle and lift apparatus appear as shown in FIGS. 1 and 2. The user then operates the drive mechanism to raise the vehicle so that vehicle repair work may be performed. Limit switch 33 limits the height to which the vehicle may be raised. Various known types of switches may be employed for this purpose.

Figure 6:
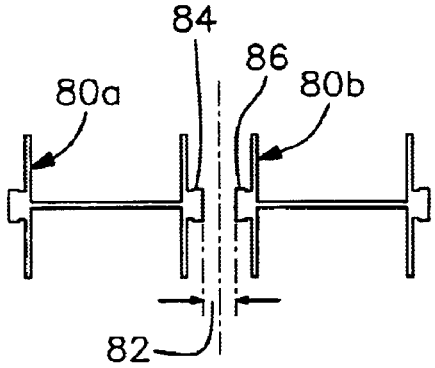
Fig. 6 Prior Art
FIG. 6 is an schematic view of a pair of conventional symmetric motor vehicle lifts mounted side-by-side in respective 12' bays of a garage.

Lift 10 provides a number of significant advantages and improvements over the prior art. For example, as shown in FIG. 6, a pair of conventional side-by-side symmetric lifts are located in respective 12" wide work bays. In both lifts 80*a* and 80*b* the support arms are shown in an open, folded condition wherein the arms in each pair are pointed in opposite directions. A standard symmetric lift has a width of about 11'6". Accordingly, this provides a space 82 of approximately 12" between adjacent vertical columns 84 and 86 of lifts 80*a* and 80*b*. This spacing makes it very difficult for workers to pass conveniently between the adjacent lifts. In facilities having even narrower bays, it may be virtually impossible to install and use this type of symmetric lift. Similar problems occur with conventional side-by-side asymmetric lifts. Little or no clearance is provided and work space efficiency is severely hindered because the number of lift spaces available is limited.

Figure 7:
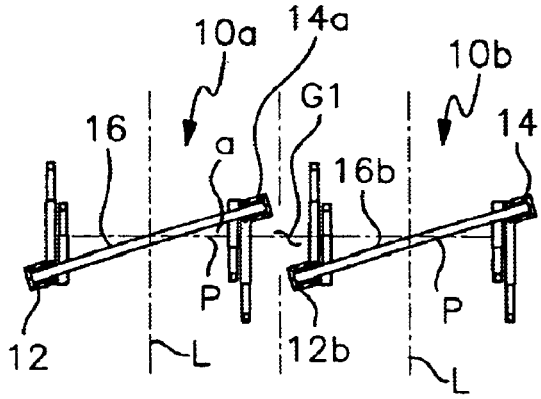
FIG. 7 is a schematic view of a pair of lifts according to this invention located in adjacent 12' bays of a garage.

In contrast, FIG. 7 depicts a pair of diagonally offset lifts 10 in accordance with this invention, which are mounted side-by-side in respective 12' wide bays. As previously described, each lift 10 includes a pair of vertical support columns 12 and 14 that are located along a line intersecting the longitudinal axis of the bay at a non-perpendicular angle. In this figure, the line interconnecting the columns is best represented by the overhead beam 16. Where each lift 10 employs an angle a of 34°, even when the lift has an overall width of 12'8", a gap G1 of approximately 29" is provided between column 14*a* of left-hand lift 10*a* and column 12*b* of right-hand lift 10*b*. The increased spacing is due in large measure to the fact that the side-by-side columns 14*a* and 12*b* are longitudinally displaced from perpendicular line/midpoint P. This provides substantially increased and more convenient space for lift operators and shop personnel to pass between the adjacent lifts.

Figure 8:
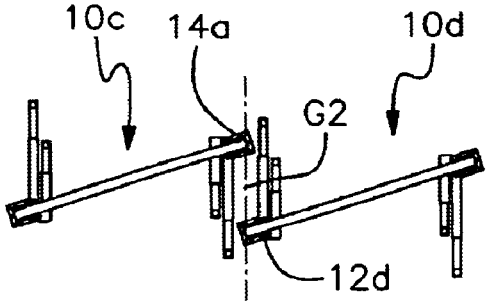
FIG. 8 is a schematic view, similar to FIG. 7, illustrating two lifts according to this invention located in adjacent 10' work bays.

Indeed, the diagonally offset lift of this invention may be effectively used in bays as narrow as about 10', as shown in FIG. 8. In this case, the lifts 10*c* and 10*d* are positioned within the respective bays such that column 14*d* of lift 10*d* along the longitudinal axes of the bays. Nonetheless, a gap G2 in excess of 2' is provided between the adjacent columns 14*c* and 12*d*. This gap is sufficient for personnel to pass conveniently and comfortably between the side-by-side lifts. Once again, the work space efficiency of the facility is improved considerably. Even narrow bays can utilize the diagonally offset lift 10. A facility can therefore maximize the usage of its available space and employ the maximum possible number of lifts within a given space.

The lift of this invention also represents a significant improvement over conventional lifts because it removes the vertical support columns as a potential obstruction to the doors of the vehicle positioned on the lift. As shown in FIG. 9, a conventional symmetric lift 80*e* requires that the motor vehicle MV1 be positioned evenly on the lift so that the vehicle's weight is properly balanced and supported when the lift is operated. When the motor vehicle constitutes an automobile, the driver's door cannot be opened without striking the left-hand column 86*e*. This can make it difficult and inconvenient for the lift operator to get out of the vehicle after it is positioned on the lift and to return to the vehicle when the time comes to remove it from the lift.

As shown in FIG. 10, the present invention overcomes the foregoing problem. Therein, motor vehicle MV1 is positioned on lift 10 between columns 12 and 14, which are diagonally offset along respective sides of axis L. The support arms 18, 20 and 22, 24 are depicted in a folded condition prior to or following engagement of the arms with the undercarriage of the vehicle. This is typically the condition that the lift will be in when the lift operator first positions motor vehicle MV1 onto the lift or, alternatively, when the lift operator is ready to remove the motor vehicle from the lift. Because the lift columns are diagonally offset relative to the longitudinal axis of the vehicle, column 12 is positioned sufficiently rearwardly along the left-hand side of the vehicle to avoid being struck by door D when the door is opened. The column does not block or obstruct the door. The lift operator therefore may enter and leave the vehicle quickly and conveniently without bumping the door on the vertical column or without any other interference from the column. By the same token, the doors on vans and various other motor vehicles may be opened and closed without obstruction or restriction of any kind from the columns.

The lift of this invention provides a number of additional advantages. A vehicle can enter the lift from either direction and be positioned quickly and successfully on the lift in a well balanced manner. In all cases, the column located on the driver's side is located sufficiently rearwardly so that the door may be opened and closed without restriction. Likewise, in all cases the support arms may be deployed beneath the undercarriage of the vehicle and pivotably positioned beneath the vehicle so that well balanced symmetric support is provided for the vehicle. The arms are readily adjustable and positionable beneath cars having short wheel bases. It is no longer necessary to repeatedly move the vehicle to clear the wheels and achieve a balanced positioning on the lift. The asymmetric arms and telescopic adjustability allows the arms to contact the undercarriage of the vehicle over a wide area. As a result, the lift is adaptable for use on virtually all types of motor vehicles.

Because the columns are diagonally offset relative to the longitudinal axis, they can be spaced far enough apart to provide ease of entry for virtually any vehicle. Even extremely wide vehicles may be accommodated conveniently by lift 10. At the same time, comfortable access and clearance is provided between adjacent lifts and spacing efficiency is improved as described above. The lift may be employed in bays having a wide variety of widths.

An additional advantage is achieved by positioning the diagonally offset columns such that they face one another. If the columns are offset diagonally in the manner previously described but their respective longitudinal channels are oriented to face in a direction perpendicular to the longitudinal axis of the vehicle, this would create an uneven load on the carriage bearings of the lift mechanism. Over time, the lift would likely experience uneven bearing wear and require expensive repairs. By arranging the openings of the longitudinal channels such that they directly face one another along the diagonal offset line, this problem is avoided. An even bearing load is achieved during the lifting operation despite the diagonal offset. Improved bearing life and reduced maintenance cost are thereby achieved.

Likewise, many asymmetric lifts (which employ support arms similar to those described herein) feature vertical columns that face a direction perpendicular to the longitudinal axis of the vehicle. This again results in uneven bearing load and premature bearing wear. The present invention overcomes this difficulty and accomplishes the other benefits described above by uniquely diagonally offsetting the columns relative to longitudinal axis L and orientating the columns such that they directly face one another, i.e. the longitudinal channels of the columns and the support arms mounted therein face one another while being diagonally offset such that a line extending between the respective facing channels intersects the longitudinal axis of the vehicle at a non-perpendicular angle. Balanced support in a manner similar to that achieved by symmetric lifts is therefore obtained and even carriage bearing wear is exhibited.

The diagonally offset columns enable the transverse beam 16 to cover a greater area of the vehicle than is covered by a conventional perpendicular beam. This increases the likelihood that the attached limit switch will be engaged if the vehicle is raised too high. Improved vehicle protection and user safety are thereby achieved.

It should be understood that the lift of the invention may also be used to support and selectively elevate various marine vessels. The structural principles described above apply analogously in such applications.

From the foregoing it may be seen that the apparatus of this invention provides for a lift for motor vehicles and marine vessels, and more particularly, to a lift having vertical support columns that are offset diagonally along the longitudinal axis of the lift bay. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. An asymmetric lift apparatus for lifting a land or water vehicle, said apparatus comprising:

first and second support columns for positioning along respective opposite sides of a vehicle bay, which bay is sufficiently wide to accommodate the vehicle to be lifted, said columns being diagonally offset relative to a longitudinal axis of the vehicle bay and arranged along a line that intersects the longitudinal axis of said vehicle bay at a non-perpendicular angle;

each column supporting a respective carriage for moving in upward and downward vertical directions along said column;

a first pair of asymmetrically foldable support arms pivotably attached to one said carriage and a second pair of asymmetrically foldable support arms pivotably attached to the other said carriage, said carriages and said respective pairs of support arms engaging and extending from respective opposing sides of said first and second columns, which opposing sides face one another in opposing directions with one of said opposing sides facing inwardly and forwardly relative to the vehicle bay and the other opposing side facing inwardly and rearwardly relative to the vehicle bay;

said support arms in each said pair for pivoting together into a collapsed condition and for pivoting apart into an extended condition wherein said support arms and said pair are deployed at an angle greater than 0° to one another for engaging an undercarriage of a vehicle to provide a balanced, symmetric support for the vehicle; and a drive mechanism operatively connected to said carriages, said drive mechanism being operated selectively in a forward direction to raise said carriages and said first and second pairs of support arms along said respective columns and in a reverse direction to lower said carriages and said first and second pairs of support arms along said respective columns, whereby the vehicle supported on said support arms is lifted and lowered respectively.

2. The apparatus of claim 1 in which one column is positionable forwardly of the center of gravity of the vehicle and the other column is positionable rearwardly of the center of gravity of the vehicle.

3. The apparatus of claim 1 in which said columns include respective longitudinal channels formed in said opposing sides of said columns, which longitudinal channels directly oppose and face each other with one of said channels facing inwardly and forwardly relatively to the vehicle bay and the other said channel facing inwardly and rearwardly relative to the vehicle bay, said carriages and said first and second pairs of support arms being respectively mounted within said channels for moving along said columns.

4. The apparatus of claim 3 in which said columns are arranged along a centerline that centrally connects said respective channels, said centerline intersecting the longitudinal axis of said vehicle bay at a non-perpendicular angle.

5. The apparatus of claim 4 in which said angle is at least 50° and not greater than 60°.

6. The apparatus of claim 1 in which said angle is at least 50° and not greater than 60°.

7. The apparatus of claim 1 in which at least on said arm is longitudinally adjustable for positioning said arm at a selected location on the lower support surface of the vehicle to be lifted.

8. The apparatus of claim 1 in which at least one said arm is telescopically adjustable for positioning said arm at a selected location on the lower support surface of the vehicle to be lifted.

9. The apparatus of claim 1 further including an elongate beam that interconnects upper ends of said columns.

10. The apparatus of claim 9 in which said beam carries a limit switch that is engagable by a vehicle being raised by said lift to deactivate said drive mechanism and stop upward movement of said support arms.

11. An asymmetric lift apparatus for lifting a land or water vehicle within a vehicle bay, which bay is sufficiently wide to accommodate the vehicle to be lifted, said apparatus comprising:

first and second support columns for positioning along respective opposite sides of a vehicle bay, which bay is sufficiently wide to accommodate the vehicle to be lifted, said columns being diagonally offset relative to a longitudinal axis of the vehicle bay and arranged along a line that intersects the longitudinal axis of said vehicle bay at a non-perpendicular angle;

each column supporting a respective carriage for moving in upward and downward vertical directions along said column;

a first pair of asymmetrically foldable support arms pivotably attached to one said carriage and a second pair of asymmetrically foldable support arms pivotably attached to the other said carriage, said carriages and said respective pairs of support arms engaging and extending from respective opposing sides of said first and second columns, which opposing sides face one another in opposing directions with one of said opposing sides facing inwardly and forwardly relative to the vehicle bay and the other opposing side facing inwardly and rearwardly relative to the vehicle bay;

said support arms in each said pair for pivoting together into a collapsed condition and for pivoting apart into an extended condition wherein said support arms and said pair are deployed at an angle greater than 0° to one another for engaging an undercarriage of a vehicle to provide a balanced, symmetric support for the vehicle; and a drive mechanism operatively connected to said carriages, said drive mechanism being operated selectively in a forward direction to raise said carriages and said first and second pairs of support arms along said respective columns and in a reverse direction to lower said carriages and said first and second pairs of support arms along said respective columns, whereby the vehicle supported on said support arms is lifted and lowered respectively.

12. The apparatus of claim 11 in which one column is positionable forwardly of the center of gravity of the vehicle and the other column is positionable rearwardly of the center of gravity of the vehicle.

13. The apparatus of claim 11 further including an elongate beam that interconnects upper ends of said columns.

14. The apparatus of claim 13 in which said beam carries a limit switch that is engagable by a vehicle being raised by said lift to deactivate said drive mechanism and stop upward movement of said support arms.

15. The apparatus of claim 11 in which said angle is at least 50° and not greater than 60°.

16. The apparatus of claim 11 in which each pair of support arms comprises a pair of asymmetrically foldable arms, each arm for pivoting between a folded condition wherein said arms are juxtaposed and an extended condition wherein said arms are deployed for engaging a lower support surface of the vehicle to be lifted.

17. The apparatus of claim 11 in which at least on said arm is longitudinally adjustable for positioning said arm at a selected location on the lower support surface of the vehicle to be lifted.

18. The apparatus of claim 11 in which at least one said arm is telescopically adjustable for positioning said arm at a selected location on the lower support surface of the vehicle to be lifted.

19. The apparatus of claim 11 in which said columns include respective longitudinal channels formed in said opposing sides of said columns, which longitudinal channels directly oppose and face each other with one of said channels facing inwardly and forwardly relative to the vehicle bay and the other said channel facing inwardly and rearwardly relative to the vehicle bay, said carriages and said first and second pairs of support arms being respectively mounted within said channels for moving along said columns.

* * * * *